United States Patent [19]

Hartman

[11] Patent Number: 4,527,225

[45] Date of Patent: Jul. 2, 1985

[54] LAMP AND SUPPORT THEREFOR

[76] Inventor: Cedric Hartman, P.O. Box 3842, Omaha, Nebr. 68103

[21] Appl. No.: 563,923

[22] Filed: Dec. 21, 1983

[51] Int. Cl.[3] ..... F21V 29/00

[52] U.S. Cl. ..... 362/294; 362/304; 362/345; 362/346; 362/362; 362/373; 362/413; 362/414; 362/419; 362/427; 362/431; 248/415; 248/416; 248/425; 339/8 R; 339/8 P

[58] Field of Search ..... 362/294, 414, 304, 419, 362/345, 427, 346, 431, 362, 373, 413; 248/415, 416, 425; 339/8 R, 8 P

[56] References Cited

U.S. PATENT DOCUMENTS

| | | | |
|---|---|---|---|
| 434,743 | 8/1890 | Trapp | 248/415 |
| 584,795 | 6/1897 | Schrader | 248/415 |
| 1,541,752 | 6/1925 | Sampson | 362/413 |
| 1,636,211 | 7/1927 | Bramming | 362/413 |
| 3,409,265 | 11/1968 | Wichers et al. | 248/415 |

FOREIGN PATENT DOCUMENTS

| | | | |
|---|---|---|---|
| 133576 | 5/1933 | Austria | 362/413 |
| 1320952 | 10/1963 | France | 362/413 |

*Primary Examiner*—Stephen J. Lechert, Jr.

[57] ABSTRACT

Electric floor lamp comprising a generally conical base rotatably mounted on a stationary annular base. A column is fixed on and extends upwards from the conical base. At the upper end of the column, a laterally extending arm supports a lamp and two light directing members, one above and one below the lamp. The upper light directing member includes concentric rings spaced apart to provide air circulation. Height adjustment means are provided to change the elevation of the lamp above the floor.

26 Claims, 24 Drawing Figures

Fig. 20.
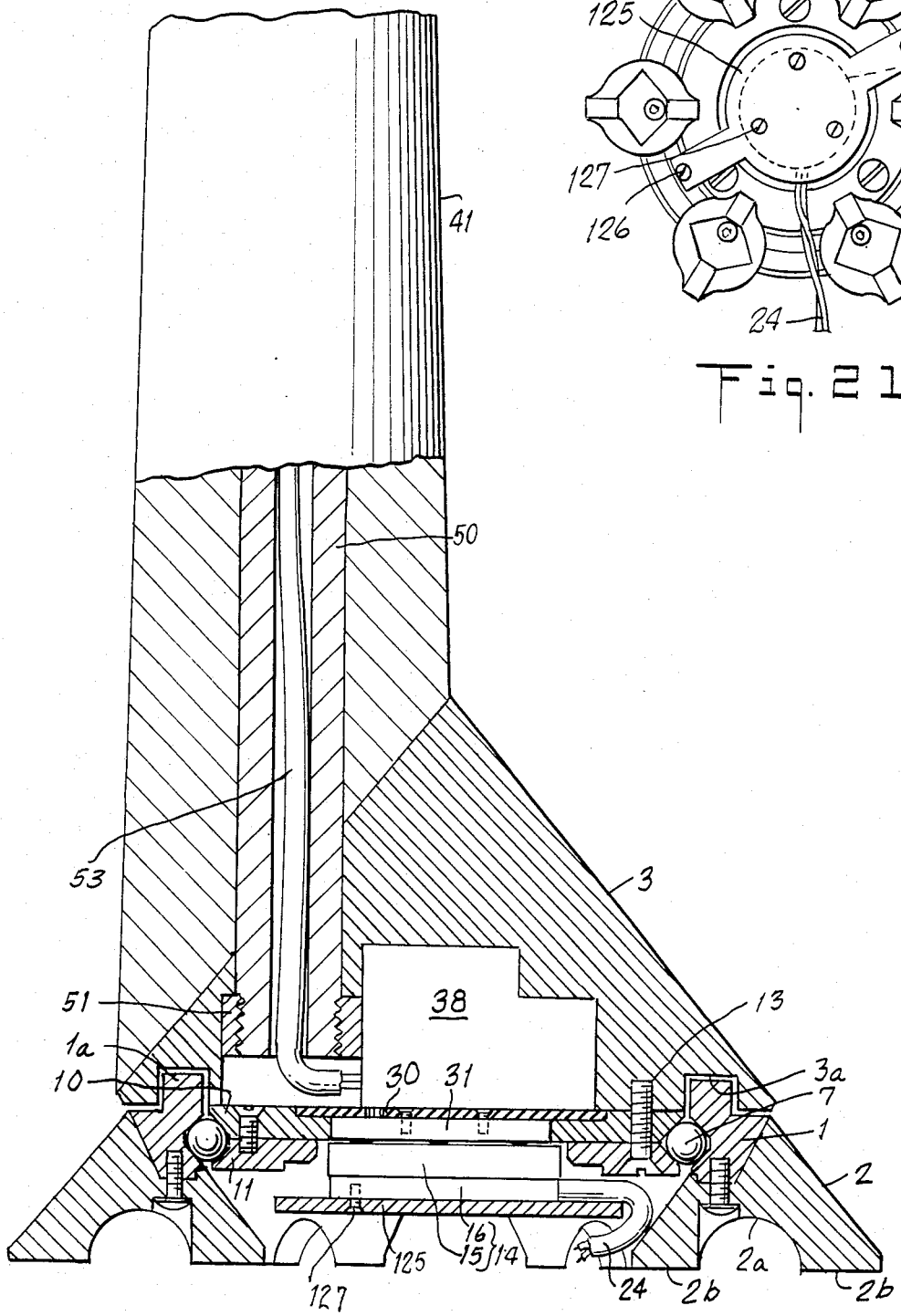
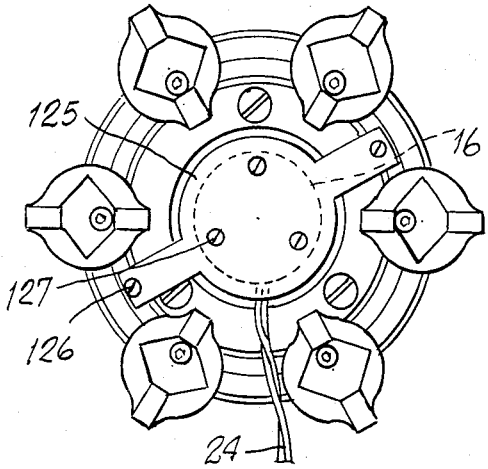
Fig. 21.

LAMP AND SUPPORT THEREFOR

BRIEF SUMMARY OF THE INVENTION

This support is an improvement on the support described and claimed in my application Ser. No. 242,331, filed Mar. 10, 1981.

This invention includes an electric lamp supported on an arm extending laterally from the top of a column. The column is mounted on a conical base capable of unlimited rotation with respect to a stationary annular base. The conical base rests on a ball bearing supported by the annular base. A terminal disk is connected by a second ball bearing to the under side of the conical base. Wires leading from the terminal disk to a commercial outlet pass between a plurality of legs that support the stationary base. The arrangement is such that the column may be rotated without applying substantial torque to the wires leading to the terminal disk. Sliding contacts on the rotatable base supporting the column cooperate with contacts on the terminal disk, so that the only torque applied to the wires is that necessary to slide the contacts. In a modification, the terminal disk is fixedly supported on the annular base and the second ball bearing is eliminated. Hence, there is no torque applied to the wires.

The column is mounted eccentrically with respect to the conical base. The arm supporting the lamp is fixed on the column. The lamp and the center of the column are diametrically opposite with respect to the center of the base, so that the weight of the lamp is balanced by the weight of the column. The lamp is pivoted for 180° rotation about the end of the arm, but the arm is curved as a volute so that the center of the lamp is never more than 30° away from the diameter through the column center and the center of the base.

The column is constructed in sections. The conical base is thick-walled and is rotatably mounted on the annular stationary base. A thick-walled section of the column is mounted on the conical base. A plurality of thin-walled column sections are stacked above the thick-walled section. The arrangement provides a low center of gravity since the conical base and the thick-walled column section are at the bottom. The sections are fastened together by concealed nuts.

The periphery of the conical base extends outwardly beyond the fixed annular base, so that the joint between the conical base and the annular base is concealed when viewed from above.

The height of the lamp may be adjusted by separating two of the column sections, after which the upper one of the two sections is frictionally held in any adjusted position.

The lamp is mounted between two light directing members, above and below the lamp. Each light directing member is constructed with concentric rings spaced apart to give air circulation. The rings above the lamp are reflective on the bottom. The upper light directing member includes a peripherally annular outer reflector. The spacing between the rings allows circulation of air to cool the lamp.

The stationary base is supported on an underlying surface by means of a plurality of feet. Each foot comprises an arch with its bottom surfaces radially spaced with respect to the center of the base. The upper surface of each arched foot is provided with a groove to receive a ridge on the bottom surface of the annular base.

DRAWINGS

FIGS. 4 and 8 partially overlap.

FIG. 20 is a fragmentary view similar to a portion of FIG. 4, showing a modification.

FIG. 21 is a view similar to FIG. 2, showing a bottom plan view of the modification of FIG. 20.

DETAILED DESCRIPTION

FIGS. 1–4

Figure 1:
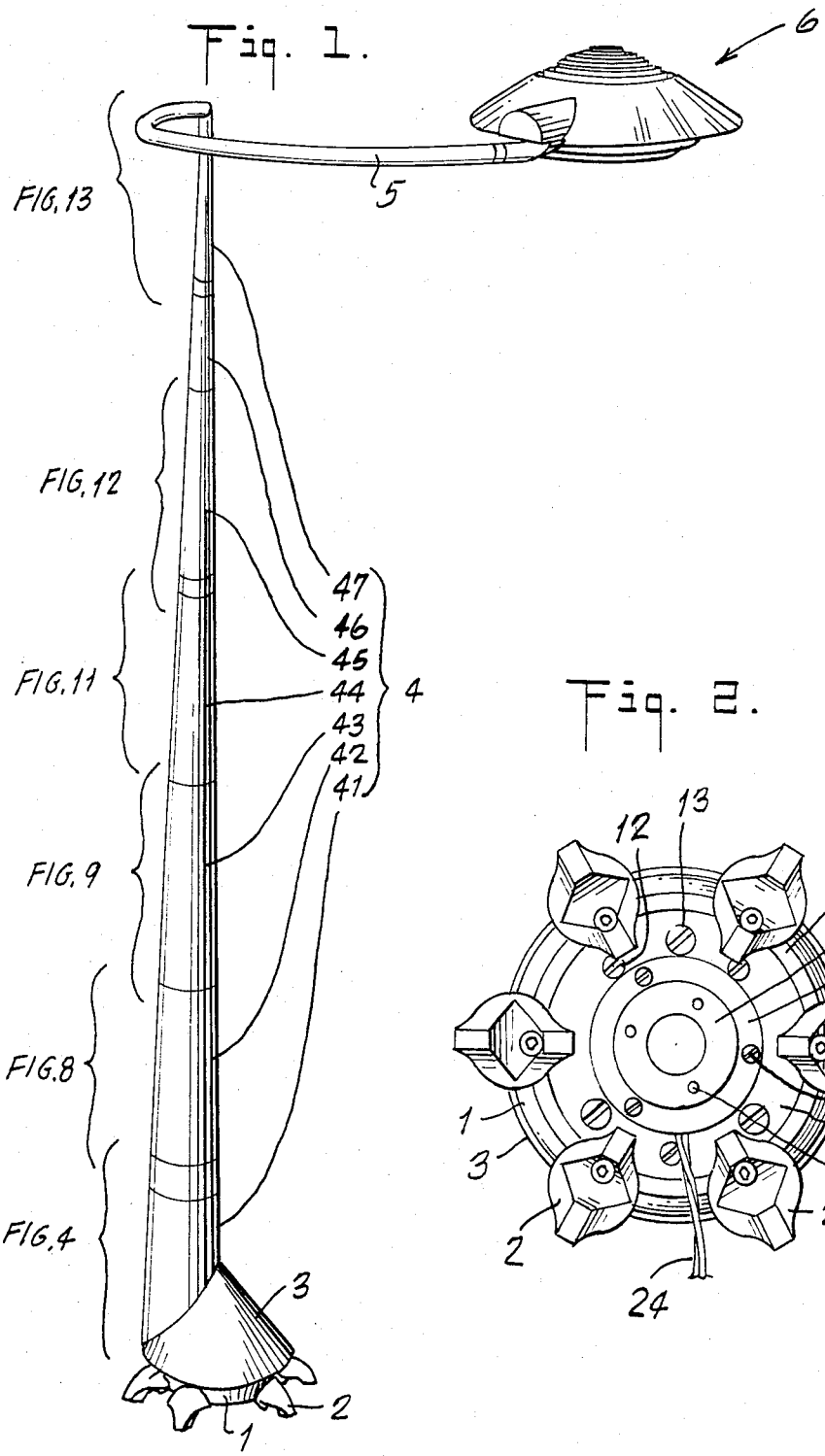
FIG. 1 is a perspective view of a floor lamp embodying the invention.
Figure 3:
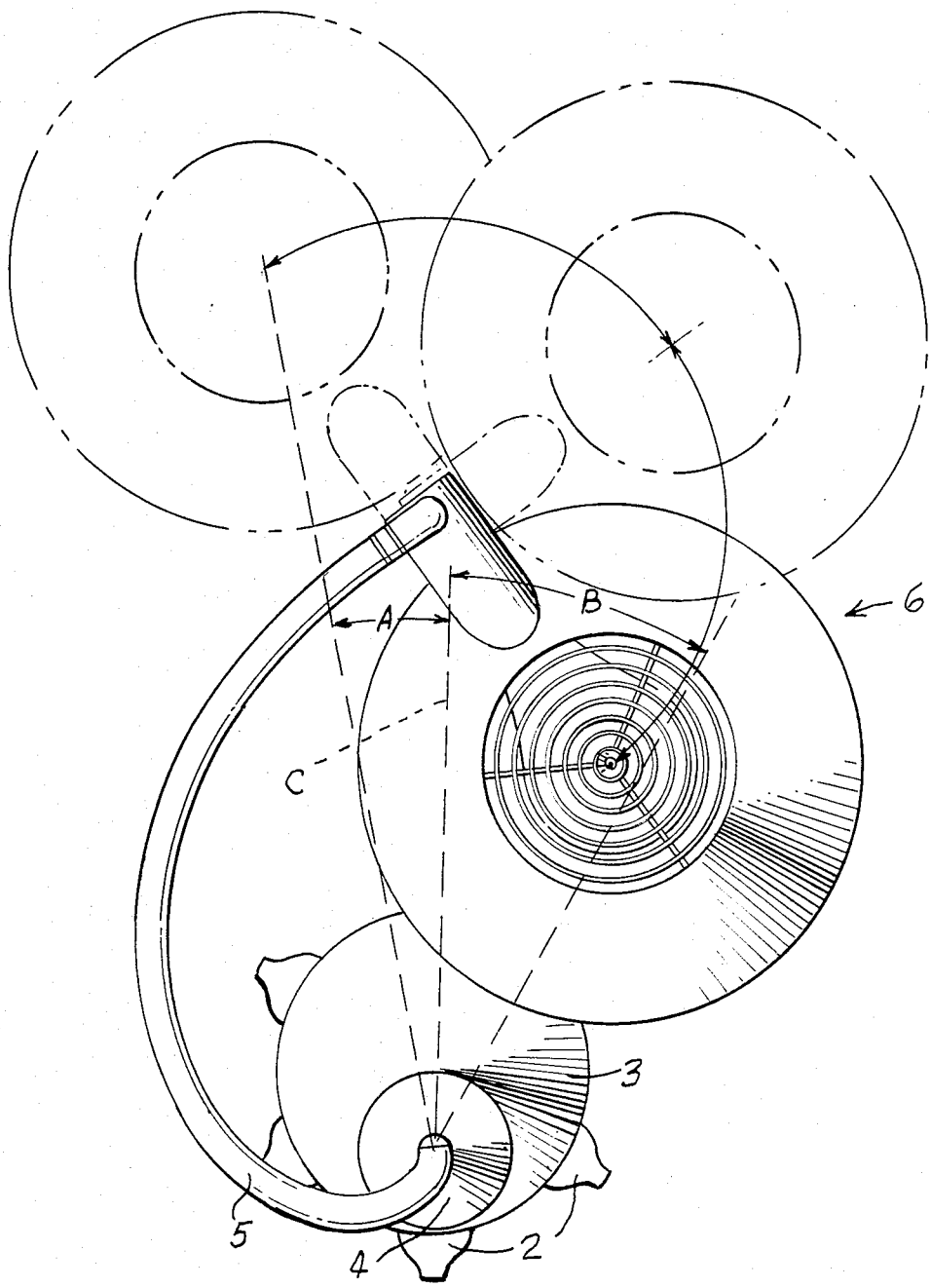
FIG. 3 is a top plan view of a modification of the floor lamp of FIG. 1, showing three positions of certain parts.

FIG. 1 illustrates a floor lamp embodying the invention, including an annular stationary base 1 supported on an underlying surface by means of six feet 2. A conical rotatable base 3 is supported on the stationary base 1 by means of a bearing to be described in detail below. A sectionalized column 4 is fixed eccentrically on top of the base 3 and orbits around the center of the base as the base rotates. At the top of the column 4 an arm 5 extends in a volute curve. The outer end of the arm 5 is substantially diametrically opposite the column 4, with respect to the center of the base 3. At the outer end of arm 5, a lamp assembly, generally indicated at 6, is supported. The lamp assembly 6 is pivotally mounted on the arm 5 so that it may be rotated about that pivot through an angle of 180°, as illustrated in FIG. 3. FIG. 3 shows a modification in which the arm 5 extends around the column 4 in a counterclockwise direction, whereas in FIG. 1, the arm 5 extends around the column 4 in a clockwise direction.

Figures 4, 6, 7:
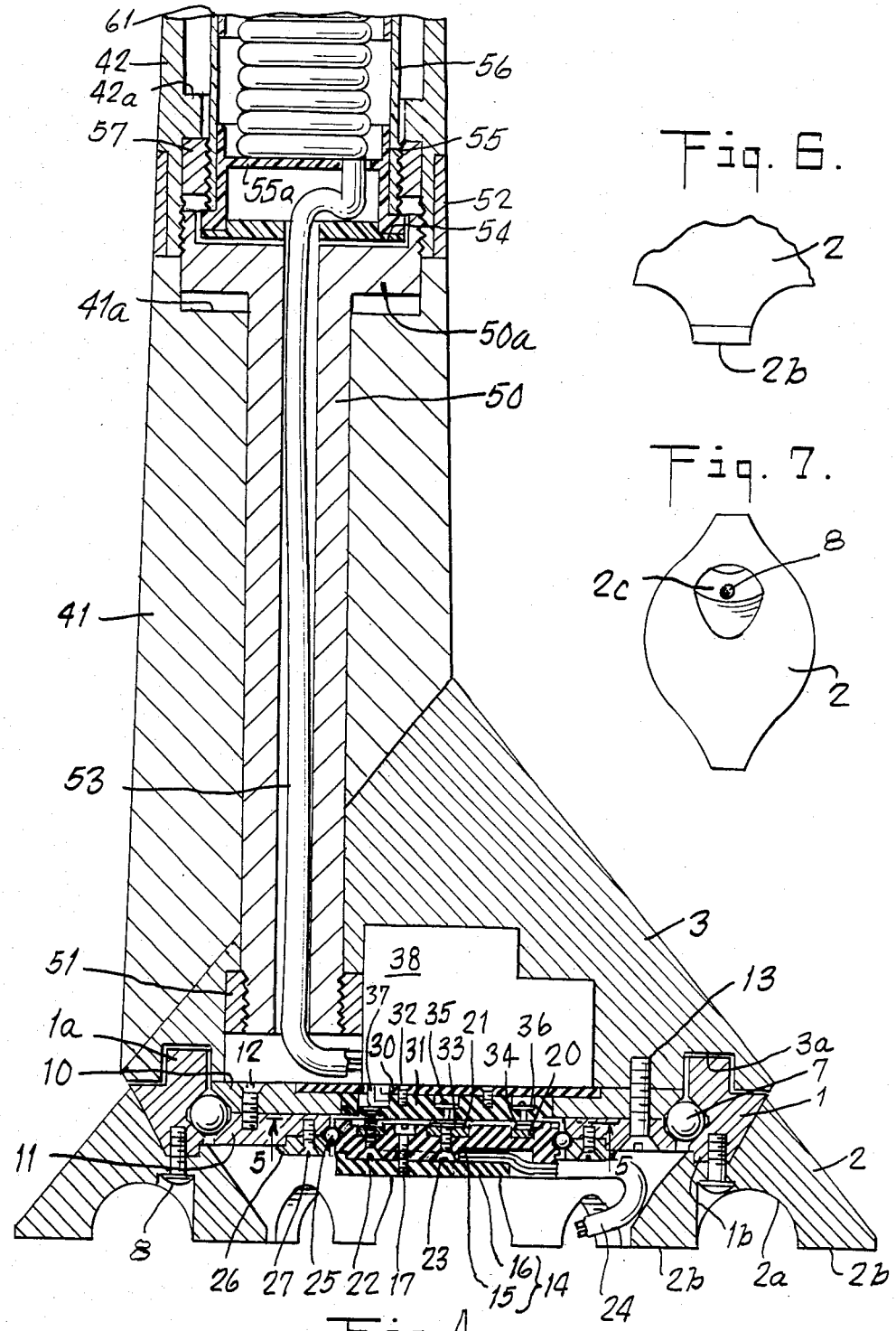
FIG. 4 is a cross-sectional view of the base and the bottom section of the column of the floor lamp of FIG. 1.
FIG. 6 is a fragmentary elevational view of one of the feet which support the base.
FIG. 7 is a top plan view of the foot of FIG. 6, on a smaller scale.

The base of the lamp includes the annular stationary base 1, and the conical rotatable base 3, which is supported on the stationary base by means of a ball bearing generally indicated at 7 (FIG. 4). The outer race of the bearing is formed on the inner periphery of the annular base 1. The inner race of the bearing 7 comprises an upper annular race member 10 and a lower annular race member 11. The race members 10 and 11 are joined together by screws, one of which is shown at 12 in FIG. 4. The inner race, comprising the two race members 10 and 11, is fixed on the bottom of the rotatable base 3 by means of screws 13, one of which is shown in FIG. 4. The balls of the bearing 7 are captured between the inner and outer races, so that the conical base member 3 and the column 4 supported thereon are rotatable as a unit on the stationary base 1. The stationary base 1 has an upwardly projecting annular ridge 1*a*, received in a recess 3*a* in the conical base member 3.

Within the annular lower race member 11, there is rotatably mounted an insulating assembly 14 which includes an upper disk 15 and a lower cover plate 16 fixed to the upper disk by means of screws, one of which is shown at 17 in FIG. 4. An annular contact 20 is located in an annular groove in the upper surface of the disk 15. A central circular contact member 21 is located in a circular recess at the center of the upper surface of the disk 14. The contact members 20 and 21 are held in place in the disk 15 by means of screws 22 and 23, respectively, which also serve as terminals for the attachment of a pair of wires 24, extending-outwardly through a channel in the top surface of the cover plate 16 and between two of the feet 2 that support the annular base 1. (See FIG. 2). The outer ends of the wires 24 are adapted for connection to a suitable source of electrical energy.

Figure 5:
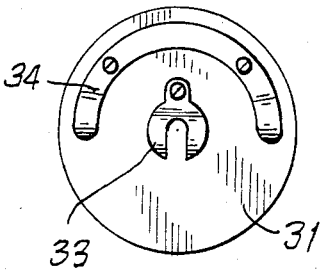
FIG. 5 is a sectional view taken on the line 5—5 of FIG. 4, with certain parts omitted.

The periphery of the disk member 15 serves as the inner race for a ball bearing 25. The outer race of the ball bearing 25 has an upper portion formed on the inner periphery of the lower race member 11. A ring 26 encircles the disk member 15 and provides the lower portion of the outer race of the ball bearing 25. The ring 26 is held in place on the lower race member 11 by a plurality of screws 27. The upper race member 10 is annular and supports on its upper surface an insulating plate 30, which in turn supports a contact holding member 31 by means of screws 32. The contact holding member 31 supports a central spring contact 33, best seen in FIG. 5, and a semiannular contact 34. The spring contact 33 continuously engages the central contact 21 in the disk member 15. The semiannular contact 34 has its ends formed as spring contacts which continuously engage the annular contact 20. This arrangement of bearings 7 and 25, and the contact arrangement illutrated, allows the base 3 to be rotated as desired on the annular base 1, without limitation as to the extent of that rotation, and without stressing the wires 24 any more than the slight force necessary to turn the disk 14 in the bearing 25. The contacts 33 and 34 are connected by screws or rivets to terminals 35 and 36 respectively, which are in turn connected to wires 37 leading to a relay generally indicated at 38, located in a recess in the conical base 3.

The contacts 20, 21, 33 and 34 preferably have their contacting surfaces gold plated to prevent oxidation, since the lamp may be allowed to remain in one angular position over a long period of time.

THE FEET

(FIGS. 2,4,6 AND 7)

The annular base 1 is shown as supported on six feet 2, each of which comprises an arch 2*a* (FIG. 4) and terminates in flat under surfaces 2*b* at its outer and inner ends, which are spaced radially with respect to the center of the base 1. The upper surface of each foot 2 is conical and is provided with a channel 2*c* (FIG. 7) which receives a portion of downwardly extending annular rib 1*b* on the lower periphery of the base member 1. The channel 2*c* is arcuate in form, as illustrated in FIG. 7, to conform to the annular configuration of the rib in the base 1. Each foot 2 is held in place on the base 1 by means of a screw 8.

THE COLUMN

(FIGS. 4 AND 8–13)

Supported on the conical base member 3 is the sectionalized column 4 including sections 41,42, 43,44,45,46,47. All of the sections 41–47 are hollow. Section 41 and the conical base member 3 are thick-walled and massive, being preferably brass, so as to provide stability to the entire lamp structure. Sections 42–46 of the column are thin-walled and may be constructed of a lighter metal such as aluminum. Section 47 is preferably of stainless steel.

The lowest column section 41 has its lower end curved to conform to the conical surface of the conical base member 3. The outer edge of the bottom surface of the column section 41 is tangential to the periphery of the base, which extends outwardly beyond the annular base member 1 and thereby conceals the base member 1 from view from above.

The column sections 41–47 are tapered slightly from a wide bottom to a narrower top. An armature bolt 50 extends through the hollow column section 41 and has a flange 50*a* at its upper end which is received in a recess 41*a* at the upper end of the column section 41. The upper end of the bolt 50 is threaded at its periphery to engage the lower end of column section 42. The lower end of the armature bolt 50 extends through an opening in the conical base 3 and is threaded to receive a nut 51, which engages a shoulder formed on the inside of base 3.

The second section 42 of the column 4 has the outer surface of its lower end recessed to receive a brass ring 52. The ring 52 has a slip fit on the recessed end of the column section 42 and is provided for ornamental purposes. The inner periphery of the lower end of the column section 42 is threaded to the upper end of the armature bolt 50. Tightening of the nut 51 holds the column section 42 down tightly against the upper end of the column section 41, and holds the column section 41 tightly against the base member 3.

A cable of wires 53 extends upwardly from the relay 38 through the hollow armature bolt 50 and through an insulating plate 54 and an insulating sleeve 55. The cable 53 may include as many wires as are required for the operation of relay 38. The plate 54 and sleeve 55 are bonded together and the sleeve 55 is also bonded to the lower end of a steel armature tube 56. The insulating sleeve 55 has a transverse wall 55*a* extending horizontally across it. The wall 55*a* is apertured to permit passage of the cable 53 which is coiled above the wall. The coiled cable provides means for maintaining the electrical connection to the lamp when the height of the lamp above the floor is adjusted, as described below. An arrangement of vertically sliding contacts might be substituted for the coiled cable.

Figure 11:
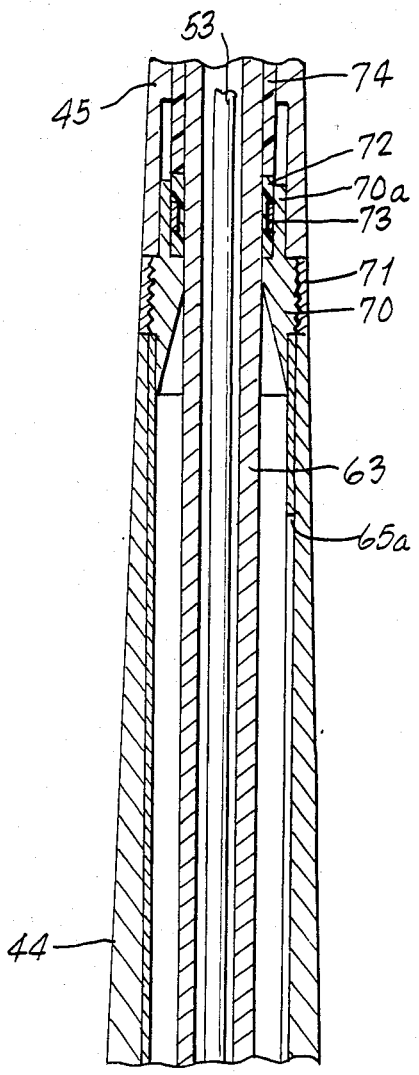
FIG. 11 is a sectional view of the section of the column above FIG. 10, partially overlapping FIG. 10.
Figure 12:
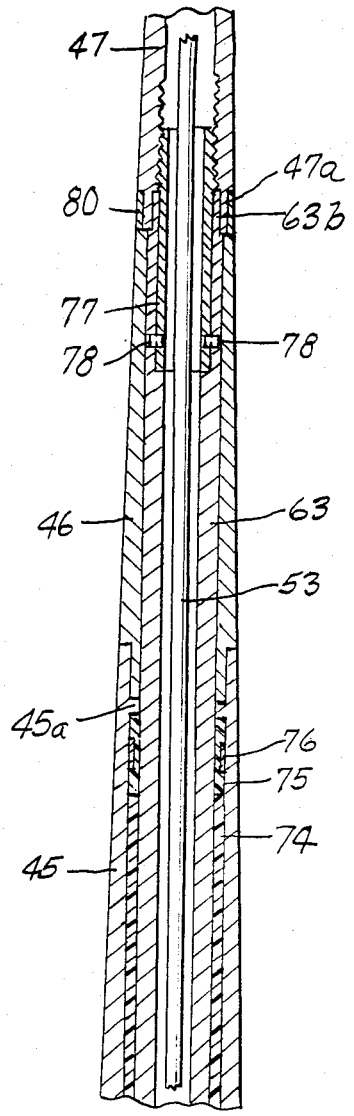
FIG. 12 is a sectional view of the section of the column above FIG. 11, partially overlapping FIG. 11.
Figure 13:
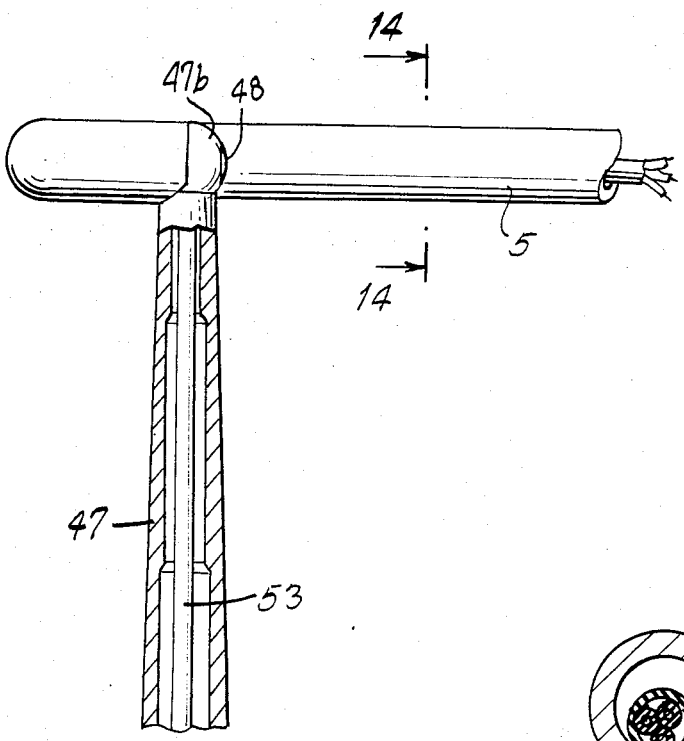
FIG. 13 is a sectional view of the uppermost section of the column above FIG. 12, partially overlapping FIG. 12, and showing a portion of the lamp supporting arm in elevation.

A nut 57 is threaded on the outside of the lower end of steel armature tube 56 and abuts against an inwardly extending flange 42*a* on the column section 42. The function of the nut 57 is described below in connection with FIG. 11.

FIG. 8

The upper end of the column section 42 abuts against the lower end another column section 43. Those two column sections are provided with interfitting flanges, as shown at 58. Inside the steel armature tube 56, and spaced above the sleeve 55, there is provided another insulating sleeve 61, which encircles the coiled portion of the cable 53. The sleeve 61 is provided with a step 61*a* midway of its length and extends upwardly beyond the step. This upper end is threadedly connected to a bushing 62 of insulating material, whose upper end is threaded to the lower end of an aluminum tube 63.

FIG. 9

The upper end of the steel armature tube 56 is connected by a ring 64 to an upper steel armature tube 65 of somewhat smaller diameter. The ring 64 takes up the space between the tubes 56 and 65, and may be silver soldered to the two tubes. Alternatively, the two tubes and the connecting step formed by the ring 64 may be made in one integral piece.

The column section 44 above the column section 43, is provided with a flange which interfits with a flange on the column section 43.

A plastic bushing 66 slides between the tube 63 and the steel armature tube 65. The bushing 66 carries a key 67 which rides in a groove 63*a* formed in the tube 63 and in a slot 65*a* formed in the steel armature tube 65. The key 67 prevents relative rotation of the tubes 65 and 63.

FIG. 11

The upper end of the steel armature tube 53 is attached by silver soldering to a brass cap 70. The outer surface of the brass cap 70 is threaded and receives a threaded brass ring 71, which serves as a nut. The brass ring 71 at the upper end and the nut 57 at the lower end cooperate to hold tightly together the column sections 42,43 and 44.

The upper end of the cap 70 has an upwardly projecting flange 70*a* which extends within the lower end of the column section 45. Between the flange 70*a* and the tube 63, there is provided a friction ring 72 of suitable material, e.g., Teflon. The middle of the ring 72 is held frictionally against the tube 63 by a split ring clamp 73. The upper and lower ends of the ring 72, which are not so closely held by the split ring, frictionally engage the flange 70*a*.

FIG. 12

Figure 14:
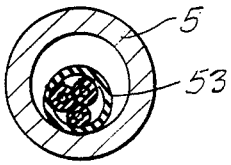
FIG. 14 is a sectional view taken on the line 14—14 of FIG. 13.

A spacer tube 74 extends upwardly from the ring 72 within the column section 45. Another friction ring 75 and a split ring clamp 76 are provided at the upper end of the spacer 74. The column section 45 has an inwardly projecting flange 45*a* which abuts the top of the friction ring 75. The upper end of column section 45 and the lower end of column section 46 have interfitting flanges. The tube 63 terminates at the upper end of the column section 46 in an upwardly projecting flange 63*b*. A hollow steel spindle 77 is fastened within the upper end of the tube 63 and projects upwardly beyond it. The column section 47 has its lower end threaded to the upper end of the steel spindle 77. The column section 47 has at its lower end a downwardly projecting flange 47*a* which encircles the flange 63*b* on the tube 63 and is encircled by a brass bushing 80, whose function is ornamental. The cable 53 extends upwardly beyond the upper end of the column section 46 and into the hollow column section 47 and the interior of the arm 5. FIG. 14 shows the arm 5 in cross-section with the cable 53 within it.

Figure 13A:
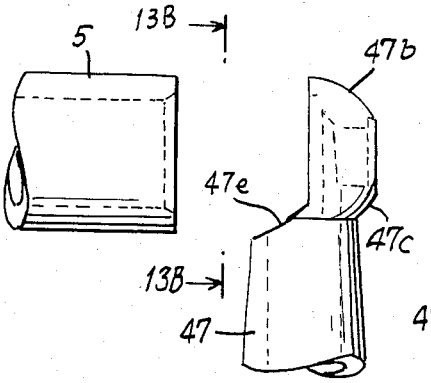
FIG. 13A is an exploded view showing the lamp supporting arm and the upper end of the column separated.
Figure 13B:
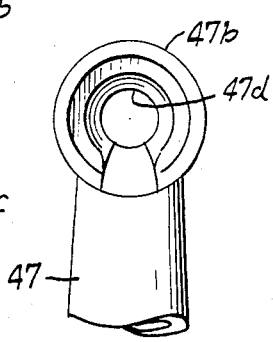
FIG. 13B is a sectional view taken on the line 13B—13B of FIG. 13A, showing the upper end of the column in detail.
Figure 13C:
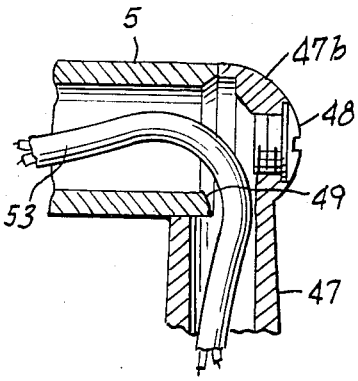
FIG. 13C is a cross-sectional view of the upper end of the column connected to the lamp supporting arm.

FIGS. 13A, 13B and 13C show how the top of the column 4 is attached to the arm 5. The top of the column section 47 terminates in a generally hemispherical portion 47*b* connected to the principal part of the column section 47 by a short inverted conical portion 47*c*. The hemispherical portion 47*b* is hollowed out and is provided with a threaded aperture 47*d* in which a screw 48 may be inserted. The arm 5 is provided at its end with a beveled opening which fits against the hemispherical portion 47*b* and a curved shoulder 47*e* on the left side of the column section 47. The arm 5 is silver soldered to the hemispherical portion 47*b* and to the shoulder 47*e*. The inner portion of the arm 5 and of the shoulder 47*e* are rounded off, as shown at 49 in FIG. 13C, to facilitate threading of the cable 53 through the joint between the column 47 and the arm 5. The screw 48 is provided to permit access to that joint for facilitating the threading of the cable 53 through it.

ASSEMBLY OF THE COLUMN

Figure 8:
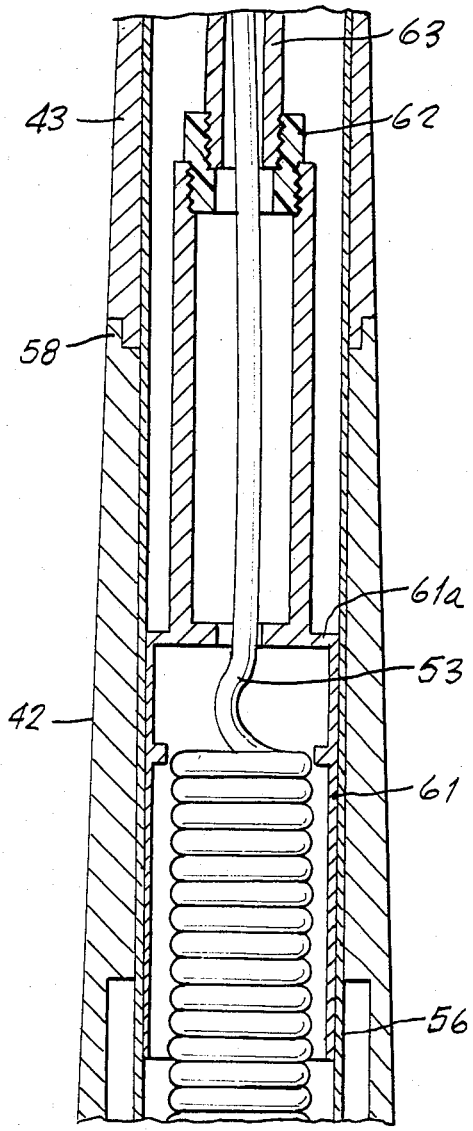
FIG. 8 is a cross-sectional view of the next section of the column above the one shown in FIG. 4.
Figure 9:
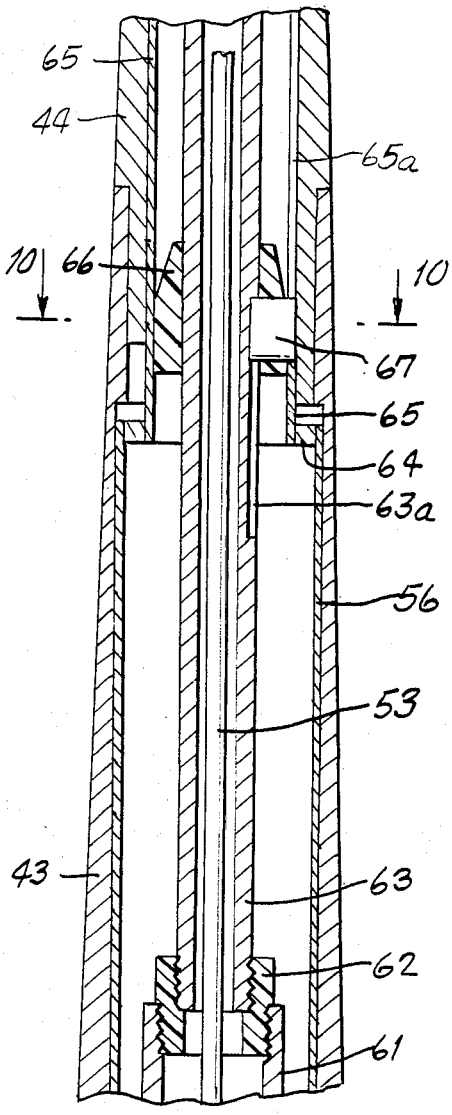
FIG. 9 is a sectional view of the next section of the column above FIG. 8, and partially overlapping FIG. 8.

The first step in assembling the column is to insert the cable 53 into the sleeve 61 (FIGS. 4 and 8), coiling the cable as shown. A sufficient length of cable should be left at both ends of the sleeve 61. The upper end of the cable is then fed through the nut 62 and tube 63 (FIGS. 8–12). The nut 62 is threaded on to the upper end of the sleeve 61 and the tube 63 is threaded on to the nut 62 (FIGS. 8 and 9). The bushing 66 (FIGS. 9 and 10) is then assembled on the tube 63.

Figure 10:
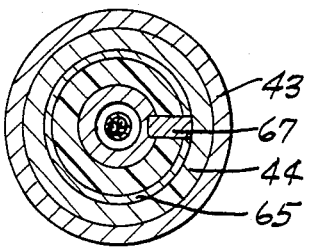
FIG. 10 is a cross-sectional view on the line 10—10 of FIG. 9.

The armature 56,64,65 (FIGS. 8–11) is assembled and placed over the sleeve 61 and the bushing 66. The cap 70 is fastened to the top of the steel armature tube 65. The key 37 is then inserted through the slot 65*a* in the armature and into the groove 63*a* in the tube 53 (FIGS. 9 and 10).

The column sections 42,43,44 are now assembled over the armature tube 65. The sliding of the column section 44 over 67 locks that key in place, so that the tube 63 and the armature 65 are held against relative rotation. The threaded bushing 71 is attached to the cap 70 on armature 65. The nut 57 (FIG. 4) is attached to the bottom of the column section 42. Bushing 71 and nut 57 are tightened, locking the sections 42,43,44 together. The friction ring 72 and clamp 73 (FIG. 11) are now inserted over the tube 63 and inside the upper flange on the cap 70. The spacer 74, friction ring 75 and clamp 76 are now assembled with the column section 45, which is slid over the tube 63 until its lower end abuts the cap 70 and the lower end of spacer 64 abuts the friction ring 72. The cable 73 is now fed through the spindle 77 and the topmost column sections 46 and 47. The spindle 77 is slipped over the tube 63 and is fastened by screws 78. The column section 46 is now assembled over the tube 63, so that its bottom end abuts the upper end of the column section 45. The column section 47 is threaded on to the sleeve 77. The fastenings at both ends of the steel spindle may be augmented by the use of a suitable bonding material.

The assembly of the column is now complete from column section 42 up through section 47.

The lower end of cable 53, below the chamber 51, is now fed through sleeve 55, plate 54, and the hollow armature bolt 50. Sleeve 55 and plate 54 are bonded in place, as shown. The ring 52 is slipped over the outer periphery of the bottom end of column section 42. The armature bolt 50 is threaded into the bottom end of the column section 42. The lower end of armature bolt 50 is inserted through the thick-walled column section 41 and through the conical base 3. Armature bolt 50 is held in place by the nut 51, thereby holding the column assembly against the conical base 3. The nuts 51 and 57 may be rotated by means of a spanner wrench.

HEIGHT ADJUSTMENT

The lamp 6 and arm 5 are shown in their lowest position. In order to raise the lamp 6, the column section 47 is grasped and moved upwardly, while holding any lower column section down. The spindle 77 and the tube 63 move upward with the section 47. The tube 63 is gripped by the friction rings 75 and 72 and is held in its new vertical position by those rings. If the upward movement of the tube 63 exceeds the length of the groove 63*a*, the key 67 moves upwardly with tube 63, with its outer end sliding in the slot 65*a* as required to accommodate the upward adjustment.

LAMP ASSEMBLY

(FIGS. 15–19)

These figures illustrate the lamp assembly 6 supported at the outer end of the arm 5. The arm 5 has an elbow at its outer end, supporting an upwardly extending pivot 81 on which turns a generally cylindrical lamp base 82 apertured to receive the pivot 81. The lamp base 82 is encircled by a partial sleeve 83 held in place by one or more screws 84. There is fixed to the sleeve 83 a lower light directing means including rings 85,86,87,88,89,90. Rings 85 and 86 are incomplete, since they are interrupted by the sleeve 83. Rings 85,86,87 and 88 are fixed directly to the sleeve 83, as by silver solder. The rings 85–90 are held together by three ribs 91, 92, 93, which extend through suitable apertures in the rings and are attached thereto by silver solder. Each of the rings 85–90 has a horizontally extending flange at its upper end for stiffening purposes and a downwardly directed flange for light directing purposes. The light directing flanges of the two inner rings 89 and 90 extend vertically downward. The light directing flanges on the other rings flare outwardly and downwardly.

Figures 16, 17, 18:
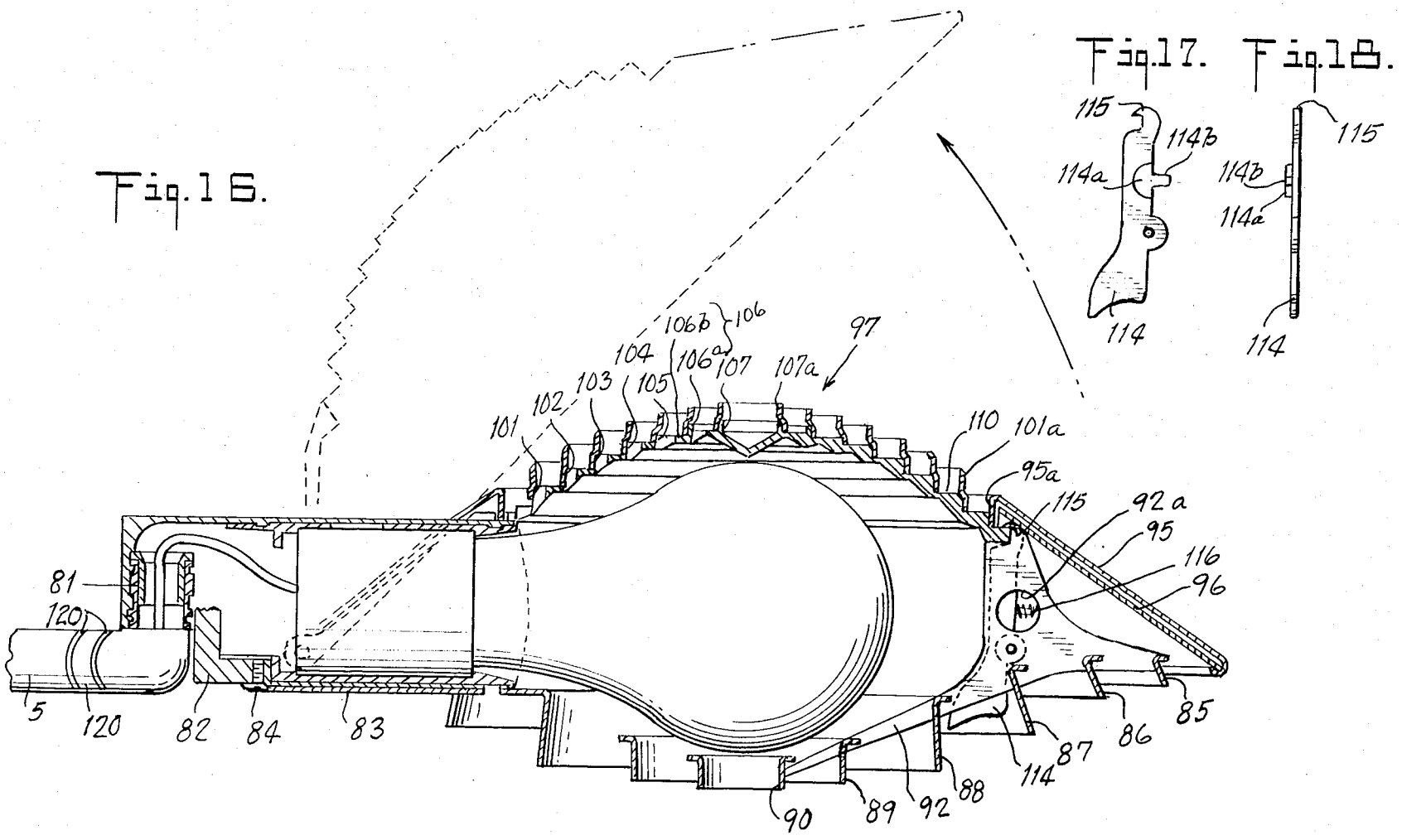
FIG. 16 is a cross-sectional view of the lamp assembly taken on the line 16—16 of FIG. 15.
FIG. 17 is an elevational view of the latch member in FIG. 16.
FIG. 18 is a side elevational view of the latch member of FIG. 17.
Figure 19:
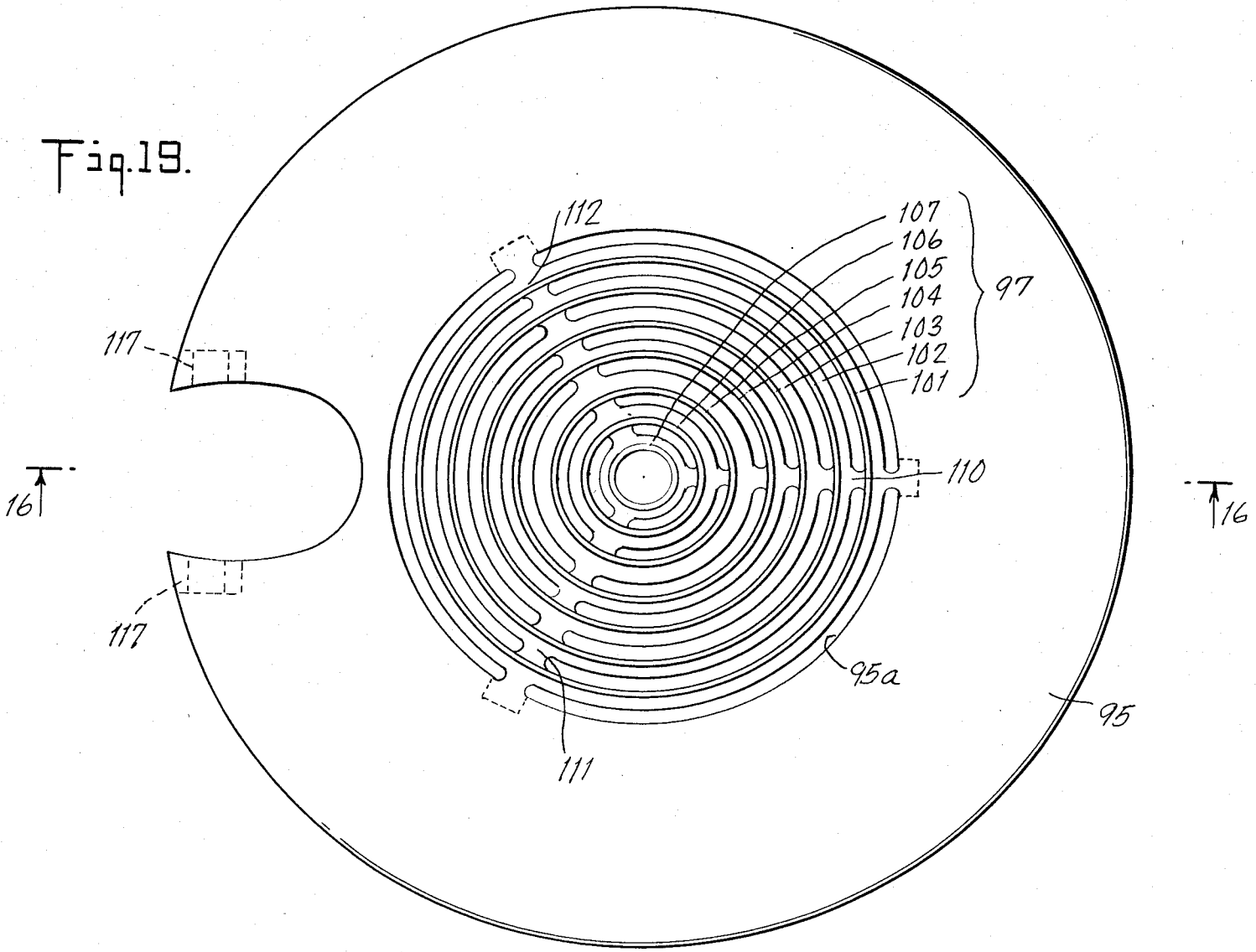
FIG. 19 is a plan view of the upper light directing means of the lamp assembly.

The sleeve 83 supports a pair of outwardly extending trunnions 94 (see FIG. 16) on which is journaled an upper light directing means (FIG. 19) comprising an annular frustoconical outer cover 95, an annular reflector 96 within the cover 95, and an upper ring assembly 97 within the inner periphery of the cover 95. The cover 95 extends diagonally downward from its upper end and has its lower edge rolled over inwardly and upwardly to receive the lower edge of the reflector 96. The inner edge of the cover 95 ends in a downwardly directed flange 95*a*. The reflector 96 is not a complete annulus because of the lamp base 82 and sleeve 83. It may be readily inserted between the flange 95*a* and the rolled over edge of cover 95. The ring assembly 97, which is preferably constructed in one piece, as shown, comprises a set of six rings 101, 102, 103, 104, 105 and 106. The center piece of the ring assembly is shown at 107 and includes a ring similar to the rings 101–106 plus a downwardly projecting inverted hollow cone at the center. Each ring 101–107 comprises an upwardly extending flange as shown at 106*a* in the case of ring 106, and a laterally directed flange at its lower end, as shown at 106*b*, having a reflecting surface for directing the light downwardly. The rings 101–107 are connected by three ribs, 110, 111, 112, which may be integral with the rings themselves. There is fastened to each of the upwardly directed flanges an upwardly projecting ring, as shown at 101*a* and 107*a* in FIG. 16. The upwardly projecting rings such as 101*a* and 107*a* may be made separately and shrunk onto the rings 101–107, as shown. Those upwardly extending flanges are desirably of a material having high heat conductivity such as copper or aluminum. The spaces between the rings allow for the venting of heated air upwardly from the lamp 113. The rings, such as 101*a* and 107*a* also serve to facilitate the dissipation of heat upwardly from the reflecting means 101–107. It is preferred to form the ring assembly 97 so that the upper outer corners of the rings such as 101*a* and 107*a* lie on the surface of a sphere, as best seen in FIG. 16.

The upper ring assembly 97 snaps into the flange 95*a* on the cover 95. For that purpose, the outer end of each rib 110, 111 and 112 is provided with a tooth adapted to engage an opening in the flange 95*a*. The ring assembly 97 is sufficiently resilient so that it may be stretched or compressed, as required, in order to release one of the teeth so that the assembly may be removed.

The rib 92 pivotally supports a latch member 114, which carries at its upper end a latch finger 115 to engage the outer end of the rib 110 which connects the rings 101 to 107. The rib 92 is provided with an upwardly extending portion having an aperture 92*a*. The latch member 114 is provided with a semicircular projection 114*a* (see FIGS. 17–18), which fits within the aperture 92. The latch member 114 also has a finger 114*b* extending to the right from the projection 114*a*, as viewed in FIG. 16. The projection 114*b* is encircled by a spring 116 compressed between the latch member 114 and rib 92 at one side of the aperture 92*a*.

When it becomes necessary to replace the lamp 113, the latch is released by pressing upwardly on the bottom of the latch 114, thereby moving the finger 115 out from above the rib 110 and allowing the upper light directing assembly to be pivoted upwardly on the trunnions 94. The cover 95 is provided with suitable journals 117 to receive the trunnions 94.

The pivot 81 allows the turning of the lamp assembly 6 through an angle of 180°, as illustrated in FIG. 3. Nevertheless, the center of gravity of the lamp assembly 6 is never more than about 30° from the diameter of the base which extends through the axis of the column 4. See the angles A and B in FIG. 3, which represent the maximum deflection of the center of the lamp assembly 6 in either direction from the diameter C. Thus, the base 3 and column 4 serve as counterweights for the lamp assembly 6 in all of its positions throughout its 180° rotation about the pivot 81.

Figure 15:
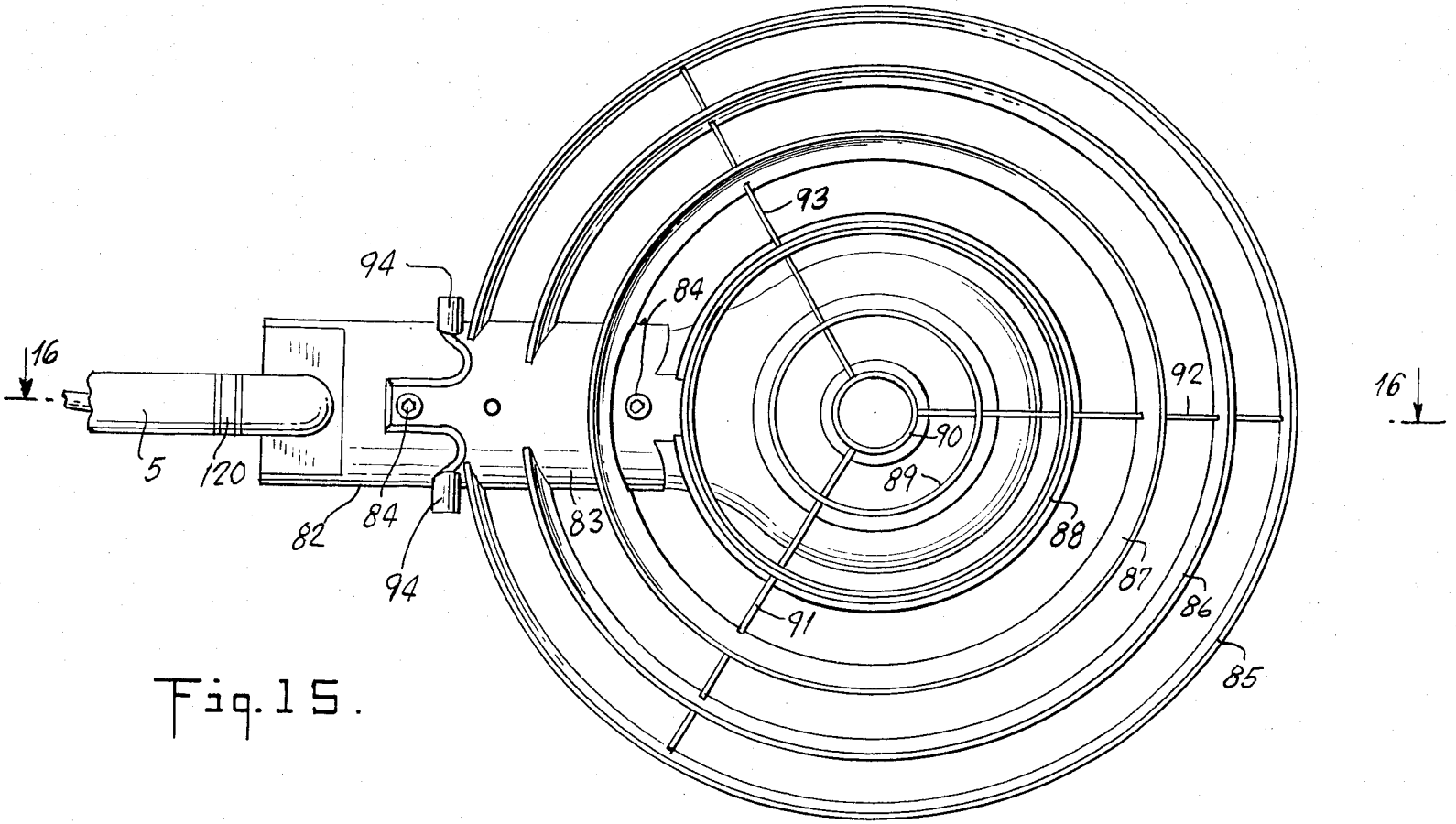
FIG. 15 is a bottom plan view of a lower light directing means at the end of the arm, with an upper light directing means removed.

The supply of energy to the lamp 113 is controlled by a sensor 120 (FIGS. 3, 15 and 16), which may be a proximity sensor or a touch sensitive sensor. Suitable circuits for controlling the supply of energy to the lamp 113 are provided in the relay 38, which is in turn controlled by the sensor 120.

The sensor 120 is separated by insulators 121 from the other parts of the arm 5. The switching of the lamp is controlled only by touching or approaching the sensor 120.

A suitable manually operable switch may be used in place of the sensor 120, in which case the relay 38 may either be used or eliminated.

The tube 63 has a fixed angular relationship with respect to the arm 5 and the lamp assembly 6. The armature 65 has a fixed angular relationship with respect to the base 3 and column 4. The key 67 maintains the tube 63 and armature 65 fixed against relative rotation, and thereby holds the outer end of arm 5 substantially diametrically opposite the column 4, with respect to the center of the base 3. Therefore, the downward torque due to the mass of the column 4 and base 3 always balances the downward torque due to arm 5 and lamp assembly 6, and the stability of the lamp as a whole is maintained.

The key 67 also functions to limit the vertical adjustment of the height of the lamp, by engaging an end of the groove 63*a* or slot 65*a*, or both, as the case may be.

FIGS. 20 AND 21

Figure 2:
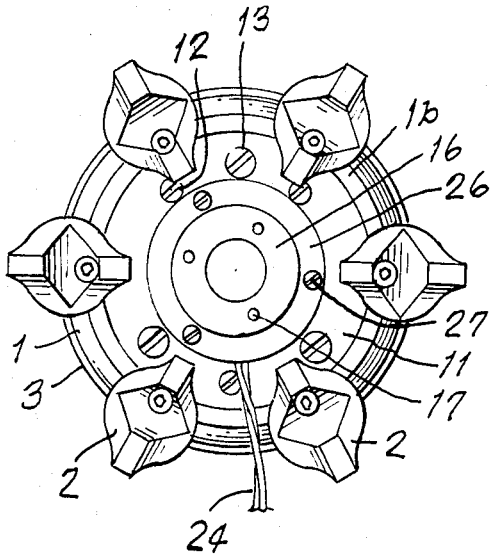
FIG. 2 is a bottom plan view of the base of the floor lamp of FIG. 1.

The modification shown in these figures is similar to that shown in FIGS. 2 and 4. In FIGS. 20 and 21, the ball bearing 25 of FIGS. 2 and 4 has been eliminated. That ball bearing supported the disk assembly 14, which was rotatable in FIGS. 3 and 4. In FIGS. 20 and 21, the corresponding disk assembly is stationary and is fixed on abridging member 125 mounted on the downwardly extending rib 1*b* on the base member 1, by means of screws 126. The bridging member in turn supports the disk assembly by suitable means, such as the screws 127 in FIG. 21.

I claim:

1. A support for an electrical device, including:

a. a stationary annular base;

b. means supporting the base above an underlying surface;

c. a rotatable member mounted for unlimited rotation within the stationary base and supporting said electrical device;

d. an insulating member mounted for unlimited rotation with respect to the bottom of the rotatable member;

e. first electrical contact means in the top of the insulating member;

f. second electrical contact means in the rotatable member above the insulating member and continuously in slidable engagement with the first contact means in all relative positions of said insulating member and said rotatable member;

g. first electrical conductor means connected to the first electrical contact means and extending outwardly through said supporting means and adapted at its outer end for connection to a source of electrical energy;

h. second electrical conductor means connected to the second electrical contact means; and i. means operable to complete a circuit between the second electrical conductor means and the electrical device.

2. A support as in claim 1, including:

a. first ball bearing means between the base and the rotatable member; and b. second ball bearing means between the rotatable member and the insulating member.

3. A support as in claim 2, in which:

a. one of said first and second contact means includes:

1. a central contact; and 2. an annular contact; and b. the other of said first and second contact means includes:

1. a first spring contact finger engaging the central contact; and 2. a second spring contact finger engaging the annular contact.

4. A support as in claim 1, including:

a. a column fixed on said rotatable member and extending vertically upwardly therefrom, said column including a plurality of hollow vertically tapered sections mounted one above the other, at least the lowermost one of said sections having relatively thick walls and the upper sections having relatively thin walls;

b. an armature tube extending upwardly within a plurality of the thin-walled sections;

c. a hollow arm extending laterally from the uppermost of the thin-walled sections;

d. means supporting said electrical device on the arm; and e. said circuit completing means extending upwardly through all said sections, said uppermost section and said arm to said electrical device.

5. A support as in claim 4, including:

a. manually operable sensing means on said arm adjacent the end thereof;

b. a relay supported within the lowermost thick-walled section of the column; and c. said circuit completing means including means connecting said sensing means to the relay.

6. A support as in claim 4, including height adjustment means for separating two sections of the column to change the elevation of the electrical device above the underlying surface.

7. A support as in claim 6, in which said circuit completing means includes extendable conductor means to accommodate operation of the height adjustment means.

8. A support as in claim 1, including:

a. a column supported eccentrically on said rotatable member;

b. an arm extending laterally from the top of the column to an end spaced laterally from the axis of rotation of the rotatable member and diametrically opposite to the axis of the column;

c. said electrical device includes a lamp; and d. swivel means at the end of the arm supporting the lamp to allow 180° rotation of the lamp about said end of the arm.

9. A support as in claim 1, including:

a. a lamp in said electrical device;

b. means supporting the lamp;

c. an upper light directing member above the lamp and supported by said supporting means;
d. a lower light directing member below the lamp and supported by said supporting means;
e. means pivotally connecting one of said light directing members to the supporting means;
f. means latching the two light directing members together, said pivotally connecting means being operable when the latching means is released to separate the two light directing members to permit removal and replacement of the lamp.

10. A support as in claim 9, in which said upper light directing member comprises:
a. an annular, convexly curved cover with an inwardly and upwardly curved rim at its outer periphery and a downwardly extending flange at its inner periphery;
b. a peripheral reflector within the cover and having an outer periphery received in said curved rim and an inner periphery abutting said flange;
c. a central reflector including a plurality of concentric, spaced, downwardly reflecting rings, and ribs connecting said rings, the spaces between the rings acting as vents to carry away air heated by the lamp; and
d. means connecting the periphery of said central reflector to said downwardly extending flange.

11. A support as in claim 10, in which each ring except the largest is spaced upwardly above the next adjacent ring of larger diameter.

12. A support as in claim 10, in which each ring has an upstanding flange and a cylinder fixed on the flange and extending vertically upward therefrom.

13. A support as in claim 9, in which each of said light directing members comprises:
a. a plurality of spaced annular rings; and
b. a plurality of ribs connecting said rings to the supporting means;
c. the spaces between the rings providing for circulation of air upwardly past the lamp.

14. Illuminating apparatus, comprising:
a. an electric lamp;
b. support means for the lamp;
c. an upper light directing member above the lamp and supported by said supporting means;
d. a lower light directing member below the lamp and supported by said supporting means;
e. means pivotally connecting one of the light directing members to the supporting means;
f. means fixedly connecting the other light directing member to the support means;
g. means latching the two light directing members together, said pivotally connecting means being operable when the latching means is released to separate the two light directing members to permit removal and replacement of the lamp.

15. A lamp as in claim 14, including:
a. a conduit section;
b. a socket in said conduit section for receiving the lamp;
c. trunnions on said conduit section pivotally supporting the upper light directing member; and
d. journals on the upper light directing member rotatably engaging the trunnions.

16. Illuminating apparatus, including:
a. an electrical lamp;
b. means supporting the lamp; and
c. a light directing member above the lamp and supported by said supporting means, said light directing member comprising:
1. an annular convexly curved cover with an an inwardly and upwardly curved rim at its outer periphery and a downwardly extending flange at its inner periphery;
2. a peripheral reflector within the cover and having an outer periphery received in said rim, and an inner periphery abutting said flange;
3. a central reflector including a plurality of concentric, spaced, downwardly reflecting rings, and ribs connecting said rings, the spaces between the rings acting as vents to carry away air heated by the lamp; and
4. means connecting the periphery of said central reflector to said downwardly extending flange.

17. Illuminating apparatus, including:
a. a lamp;
b. means supporting the lamp;
c. a light directing member below the lamp and supported by said supporting means, said lower light directing member comprising:
1. a plurality of rings, each including a downwardly extending portion and an outwardly extending flange at its upper edge;
2. some of said rings having their downwardly extending portion flaring outwardly; and
3. a plurality of ribs connecting said rings.

18. A support as in claim 17, in which the rings are concentric and each ring except the largest is spaced downardly below the next adjacent ring of larger diameter.

19. A column for supporting an electrical device, including:
a. a plurality of hollow vertically tapered sections mounted one above the other, at least the lowermost one of said sections having relatively thick walls and the upper sections having relatively thin walls;
b. an armature tube extending upwardly within a first plurality of the thin walled sections and connected at its ends to the uppermost and lowermost of said plurality of sections;
c. a conduit for receiving an electrical wire and extending upwardly within a second plurality of said thin walled sections overlapping said first plurality;
d. means connecting the upper end of said conduit to one of said thin walled sections; and
e. means at the top of said column supporting said electrical device.

20. A column as in claim 19, including:
a. means for adjusting the vertical height of said column, said means comprising:
1. a threaded steel spindle located internally of and threaded to one of said thin-walled sections and extending downwardly within said conduit, said section being separable from the section immediately below it;
2. said spindle being threaded to the upper end of said conduit so that when said one section is separated from the section below it, said conduit moves upwardly with said one section; and
3. slip friction means between said conduit and another of said thin-walled sections below said one section for retaining the conduit in any vertical position to which it may be adjusted.

21. A column as in claim 20, including means keyed to said conduit and said armature tube to prevent relative rotation thereof.

22. A foot for engaging an underlying surface and supporting a member above said surface, comprising:

a. an arch having two surfaces at the ends of the arch in the same plane and adapted to engage an underlying plane surface; and b. a groove in the top of the arch extending transversely to the span of the arch and adapted to receive said member.

23. Apparatus for engaging an underlying surface and supporting an annular member above said surface, comprising:

a. a plurality of arches, each having two surfaces at the ends of the arch located in the same plane and adapted to engage an underlying plane surface, said arches being spaced about the periphery of said supported member; and b. grooves in the top of the arches extending transversely to the span of the arch and adapted to receive said member, each said groove being arcuate and concentric with said annular member.

24. A column for supporting an electrical device, comprising:

a. a stationary base;

b. a member mounted for rotation on said base about a vertical axis;

c. a column supported eccentrically on said member, said column having an axis parallel to and spaced from the axis of rotation of the member;

d. an arm extending laterally from the top of the column to an end spaced laterally from the axis of rotation of the member in a direction diametrically opposite to the axis of the column;

e. said device being supported on said arm so that the downward torque due to its weight is opposed to and balanced by the downward torque due to the column;

f. said column including upper and lower vertically separable sections, said lower section being fixed to said member;

g. an armature extending vertically and fixed within the lower section;

h. a tube telescoped within said armature and fixed to the upper of said vertically separable sections, said upper section being fixed to said arm;

i. key means connecting said armature and said tube against relative rotation so as to maintain the balanced relationship between the torques of the device and the column; and j. slip friction means between the tube and the lower section and effective to hold the tube in any vertical position to which it may be adjusted.

25. A support for an electrical device, including:

a. a stationary annular base;

b. means supporting the base above an underlying surface;

c. a rotatable member mounted for unlimited rotation within the stationary base and supporting said electrical device;

d. a bridging member extending across the under side of the annular base and affixed thereto at its ends;

e. an insulating member mounted on the bridging member below the rotatable member and concentric therewith;

f. first electrical contact means in the top of the insulating member;

g. second electrical contact means in the rotatable member above the insulating member and continuously in slidable engagement with the first contact means in all relative positions of said insulating member and said rotatable member;

h. first electrical conductor means connected to the first electrical contact means and extending outwardly through said supporting means and adapted at its outer end for connection to a source of electrical energy;

i. second electrical conductor means connected to the second electrical contact means; and j. means operable to complete a circuit between the second electrical conductor means and the electrical device.

26. An elbow coupling between a hollow column and a hollow arm, comprising:

a. a projection on one half of the end of the column, said projection being hollow and having its interior opening into the hollow column, said projection having a part-annular flat surface aligned with the hollow interior of the column;

b. a part-cylindrical surface formed on the other half of the end of the column, said part-cylindrical surface having its ends adjoining the ends of said flat surface;

c. said hollow arm having a cylindrical end with a flat end surface abutting the flat surface and a portion of its cylindrical surface abutting the cylindrical surface on the end of the column; and d. means bonding said abutting surfaces together so that the interior of the hollow arm communicates with the interior of the hollow column.

* * * * *